US008746544B2

(12) United States Patent
Cruz

(10) Patent No.: US 8,746,544 B2
(45) Date of Patent: Jun. 10, 2014

(54) COLLAPSIBLE BOX AND LID ASSEMBLY

(75) Inventor: Andrew L. Cruz, Wilmington, DE (US)

(73) Assignee: Brand Design Company, Inc., Yorklyn (DE)

( * ) Notice: Subject to any disclaimer, the term of this patent is extended or adjusted under 35 U.S.C. 154(b) by 12 days.

(21) Appl. No.: 13/554,576

(22) Filed: Jul. 20, 2012

(65) Prior Publication Data

US 2014/0021248 A1 Jan. 23, 2014

(51) Int. Cl.
*B65D 43/08* (2006.01)
*B65D 5/10* (2006.01)

(52) U.S. Cl.
USPC ..... 229/125.19; 229/117.17; 229/173; 229/178

(58) Field of Classification Search
USPC ..... 229/117.17, 125.19, 165, 173, 178, 185
See application file for complete search history.

(56) References Cited

U.S. PATENT DOCUMENTS

| | | | | | |
|---|---|---|---|---|---|
| 502,952 | A | * | 8/1893 | Craw | 229/125.19 |
| 684,243 | A | * | 10/1901 | Hillman | 229/173 |
| 736,727 | A | * | 8/1903 | Hirsch | 229/173 |
| 2,100,750 | A | * | 11/1937 | Ringler | 229/173 |
| 2,758,781 | A | * | 8/1956 | White | 229/173 |
| 2,845,211 | A | * | 7/1958 | Hauck et al. | 229/178 |
| 2,917,220 | A | * | 12/1959 | Bostock | 229/166 |
| 2,939,624 | A | * | 6/1960 | Wilson | 229/165 |
| 3,019,959 | A | | 2/1962 | Skowronski | |
| 3,275,215 | A | | 9/1966 | Paige | |
| 3,278,108 | A | | 10/1966 | Paige | |
| 3,366,496 | A | * | 1/1968 | Bomar et al. | 229/165 |
| 3,844,473 | A | * | 10/1974 | Whelan | 229/165 |
| 3,989,181 | A | | 11/1976 | Wilcox et al. | |
| D243,663 | S | | 3/1977 | Booth | |
| D265,293 | S | | 7/1982 | Graser et al. | |
| D316,372 | S | | 4/1991 | Boggus | |
| 5,277,360 | A | * | 1/1994 | DeMott | 229/178 |
| 5,779,129 | A | * | 7/1998 | Herbst et al. | 229/125.19 |
| D397,935 | S | | 9/1998 | Herbst et al. | |
| 5,967,407 | A | | 10/1999 | Mueller | |
| D422,499 | S | | 4/2000 | Herbst et al. | |

OTHER PUBLICATIONS

Show and Tell, Strange Bedfellowes, Oct. 12, 2011, 3 pgs., http://www.houseind.com/showandtell/2011/10/12/StrangeBedfellowes.
Business Storage Solutions Guide, at least as early as Dec. 31, 2003, 16 pgs.
Paige Box 801, at least as early as Dec. 31, 2003, 1 pg.

* cited by examiner

*Primary Examiner* — Gary Elkins
(74) *Attorney, Agent, or Firm* — RatnerPrestia

(57) ABSTRACT

A collapsible cardboard box and lid. The box sides each comprise an outer face and an inner face flap connected by a fold-over region. Mitered edges of adjacent fold-over regions align to define mitered corners of the box opening periphery. Intermediate side flaps connected to the outer shell bottom are sandwiched between the side outer faces and inner face flaps, and a locking flap connected to one of the sides defines an interior bottom. The lid top face is connected to a first set of outer side faces connected by a fold-over region to inner side faces. One inner side face is connected to a top locking liner flap that extends to an abutment with the inner side face to define the lid interior. A second set of outer side faces connects to intermediate flaps sandwiched between the first set of outer side faces and inner side faces.

7 Claims, 13 Drawing Sheets

COLLAPSIBLE BOX AND LID ASSEMBLY

BACKGROUND OF THE INVENTION

Storage boxes, such as cardboard boxes, of various shapes and designs are well known in the art, many of which may be assembled by the end user from a flat configuration into a fully assembled box. Such boxes are cut from a sheet of, for example, corrugated cardboard, such as with a metal die, forming a blank. The blank may further be constructed with various fold lines and perforations to assist in constructing the fully assembled box. In some instances, certain portions of the box may be pre-glued such that the unassembled box may still be shipped to or purchased by a user in a flattened form that takes less space in inventory than the fully constructed boxes, and which can be fully assembled by folding the box in a certain sequence along the pre-made fold lines or perforations. Such boxes typically have a box portion and a lid portion, both of which have a flat configuration and a fully assembled configuration. Such storage filing boxes, some of which are known by the brand name BANKERS BOX®, sold by Fellowes, Inc. of Itasca, Ill., are robust and capable of holding relatively heavy loads. Such boxes, however, are typically intended for storage in back rooms, where the aesthetic look and feel of the box is generally not important.

There is therefore a need for a box assembly that can provide the robustness of traditional storage filing boxes, flatness for transport and space conservation until needed, and easy of assembly, with an overall aesthetically pleasing look, such as a configuration that permits easy printing of designs on the box and that, when assembled, has smooth edges and corners.

SUMMARY OF THE INVENTION

One aspect of the invention comprises a collapsible box and lid assembly comprising a collapsible box portion and a collapsible lid portion. An exemplary collapsible box portion embodiment has a fully assembled configuration defined by an outer shell having four sides and a bottom (114), and an open top defined by top edges of the four sides, each of the four sides comprising an outer face (102, 104, 106, 108) and an inner face flap (120, 118, 122, 124) connected to the outer face by a fold-over region (between 174 and 176), in which the top edges of the four sides comprise the fold-over region. Each fold-over region comprises mitered edges (180, 182, 184, 186, 188, 190, 192, 194) that align with the mitered edges of adjacent fold over regions to define mitered corners. Two of the four sides comprise an intermediate side flap (110, 112) connected to an outer face of the outer shell bottom and sandwiched between the side outer face and the side inner face flap. The box portion further comprises a locking flap (116), connected to a remaining one of the four sides, that locks the box in the assembled configuration and defines an interior bottom of the box portion.

One collapsible lid portion embodiment has a fully assembled configuration defined by a top (200), a shell having four sides (202, 204, 214, 220), and an open bottom defined by top edges of the four sides. The top has an outer face connected to a first set of opposite outer side faces defining two of the sides (214, 220). The opposite outer side faces are connected by a fold-over region (between 248 and 249) to opposite inner side faces (216, 222). Inner side face 222 is connected at a fold line (254) to top liner flap (224), which extends from inner side face 222 to an abutment with inner side face 216. The top liner flap defines an interior of the lid portion. The top outer face is connected to a second set of opposite outer side faces (202, 204) defining a remaining two of the four sides. The second set of opposite outer side faces is connected to opposite intermediate flaps (206, 208, 210, 212) sandwiched between the first set of opposite outer side faces and inner side faces.

The box in the fully assembled configuration may further comprise a flap (100) extending from one side, the flap having an outer face adhered face-to-face to an inner face of an adjacent side, the adhered flap sandwiched between the outer face and inner face of the adjacent side in the fully assembled configuration.

In some configurations, at least two of the inner side flaps of the box comprise tabs (130. 132) biased against an interior face of the outer shell bottom in the fully assembled configuration and the locking flap comprises indents (150, 152) to accommodate the tabs. Similarly, in some configurations, the lid top liner flap comprises tabs (223, 225) that mesh with indents (215, 217) of the opposite inner side face (216), to lock the lid portion in the assembled configuration.

The inner side flaps and intermediate side flaps on at least two sides each may comprise handle openings (138, 140, 134, 136), and at least two of the outer sides may each comprise a handle flap (142, 144) for folding into the handle openings.

In another lid embodiment, instead of a locking flap 224 extending from one of the short side inner liners, a pair of locking flap liners 302 and 304 may be provided extending from each of the short sides, with the overall length of the pair of locking flap liners together being such that their leading edges 303 and 305 snugly abut one another inside the lid to form a 2-piece lid liner.

Another aspect of the invention comprises the box portion as described above, with or without a lid portion as described herein. Still another aspect of the invention comprises a collapsible lid having a fully assembled configuration defined by a top, a shell having four sides, and an open bottom defined by top edges of the four sides, the top having an outer face connected to a first set of opposite outer side faces defining two of said sides. The opposite outer side faces are connected by a fold-over region to opposite inner side faces, with at least one inner side face connected at a fold line to a top locking liner flap that extends from the attached inner side face to an abutment with the opposite inner side face or an opposing top locking liner flap to lock said lid portion in said assembled configuration, the at least one top liner flap defining an interior of the lid portion. The top outer face is further connected to a second set of opposite outer side faces defining a remaining two of the four sides, and the second set of opposite outer side faces is connected to opposite intermediate flaps sandwiched between the first set of opposite outer side faces and the inner side faces.

Still other aspects of the invention include the box, the lid embodiments, and box and lid assembly embodiments depicted in FIGS. 11-20.

DETAILED DESCRIPTION OF THE INVENTION

Figure 1:
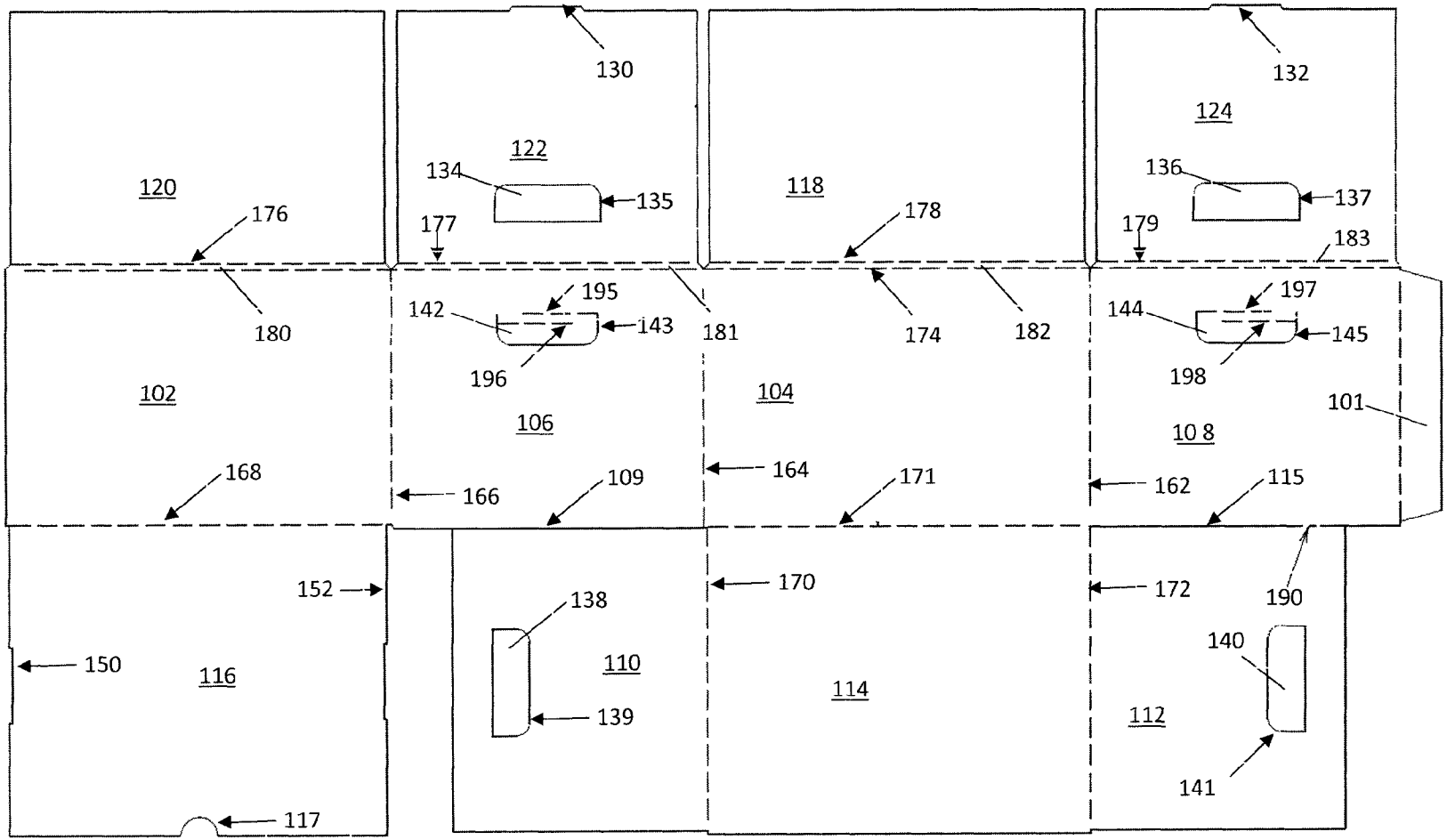
FIG. 1 is a plan view of a blank for an exemplary box portion of an exemplary box assembly in an unassembled configuration.
Figure 2:
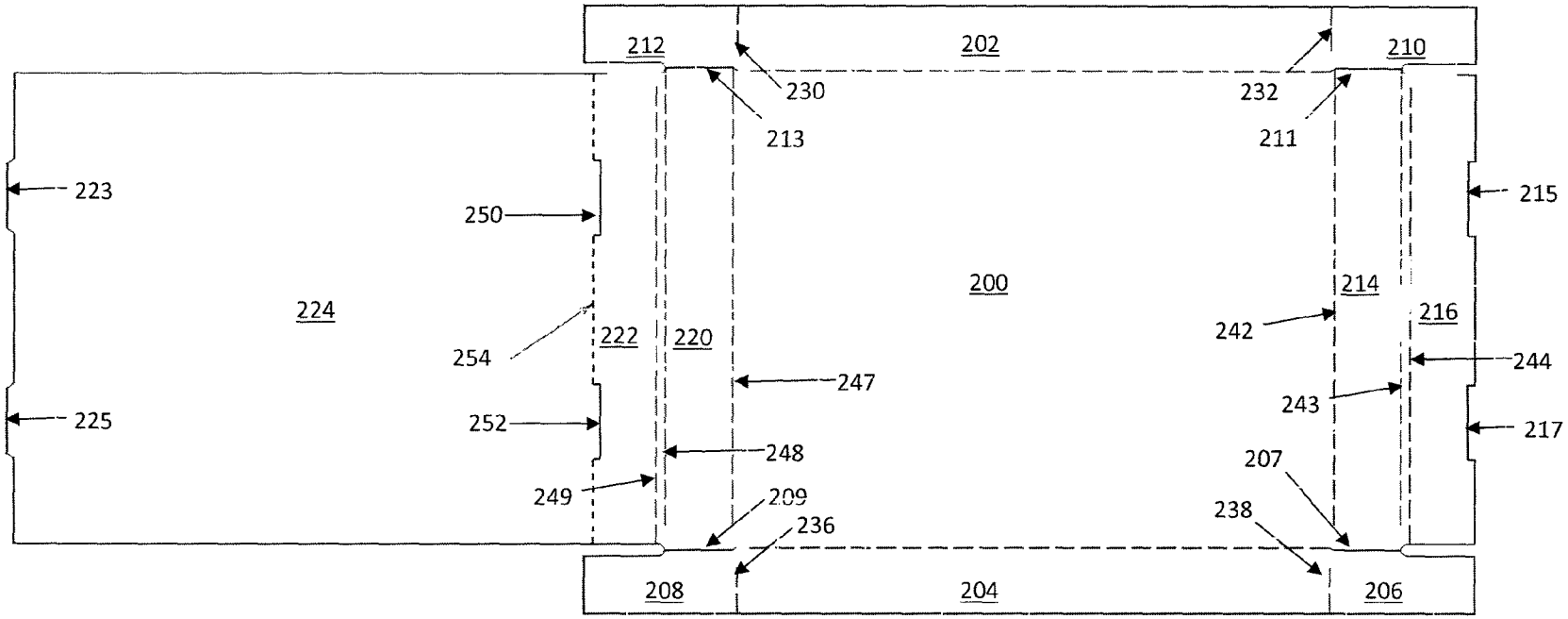
FIG. 2 is a plan view of a blank for an exemplary lid portion for use with the exemplary box portion of FIG. 1, in an unassembled configuration.
Figure 9:
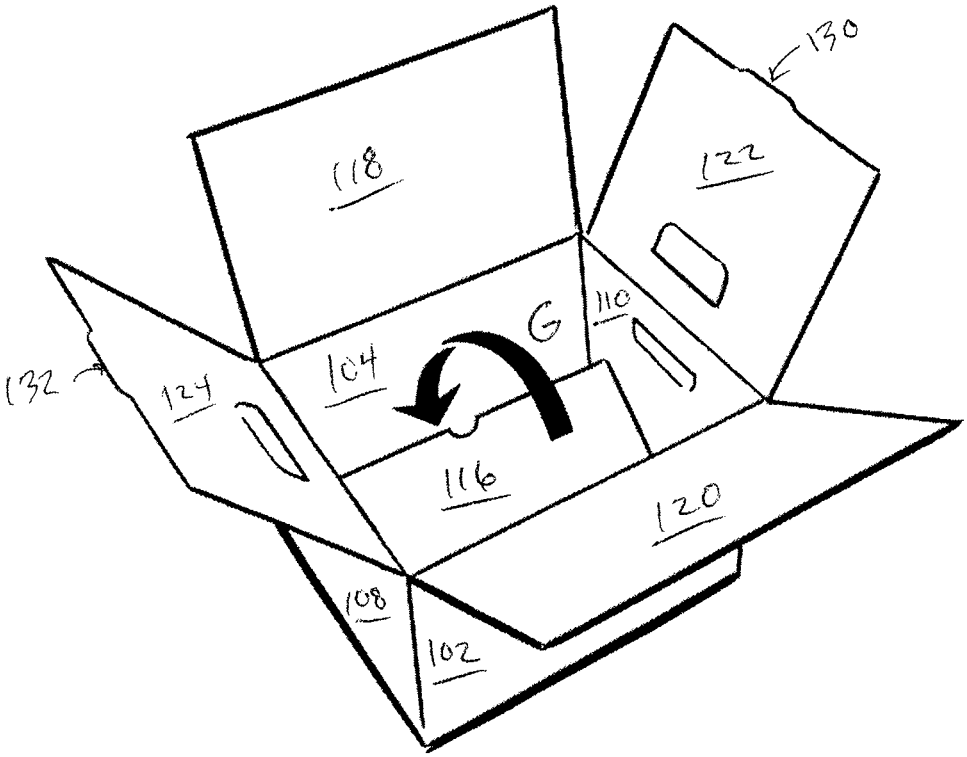
FIG. 9 is a perspective view illustrating steps after those illustrated in FIG. 8, for folding the box portion of FIG. 1 from an unassembled into an assembled configuration.
Figure 10:
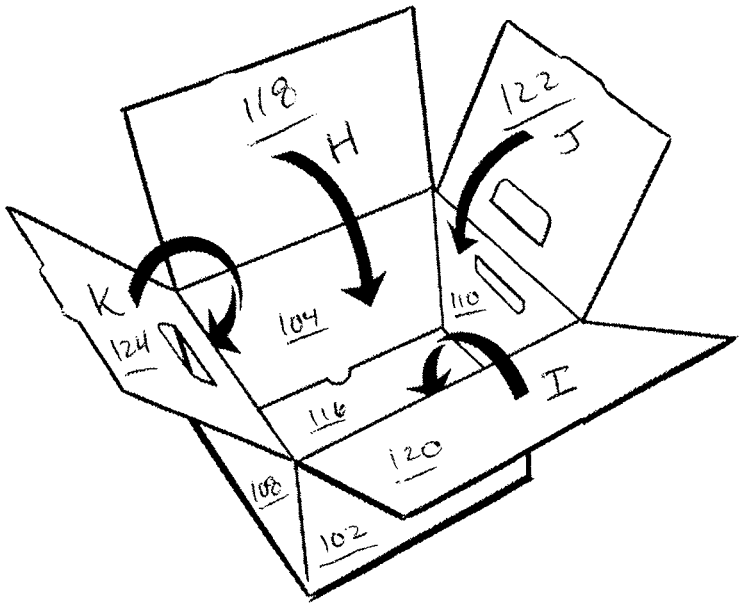
FIG. 10 is a perspective view illustrating steps after those illustrated in FIG. 9, for folding the box portion of FIG. 1 from an unassembled into an assembled configuration.
Figure 11:
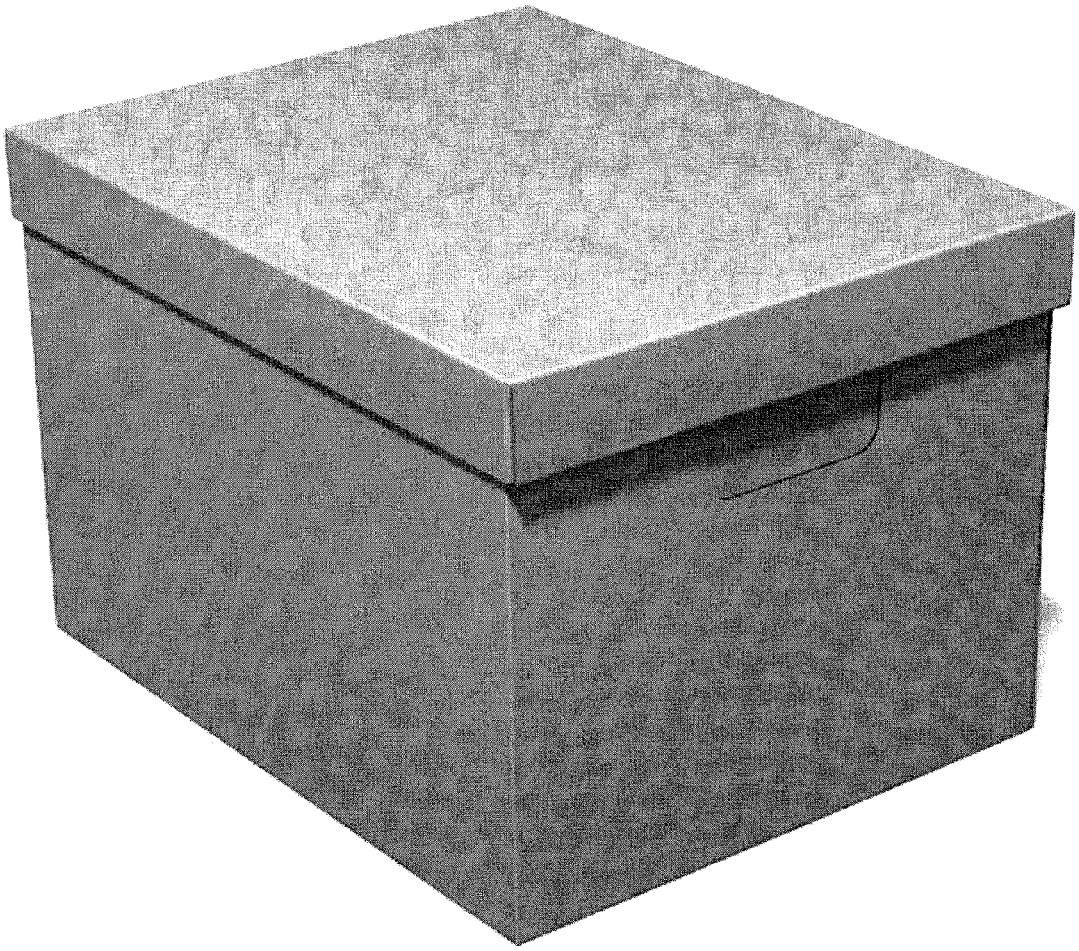
FIG. 11 is a 3-D rendering of a perspective view of the box and lid assembly with the lid on the box.
Figure 12:
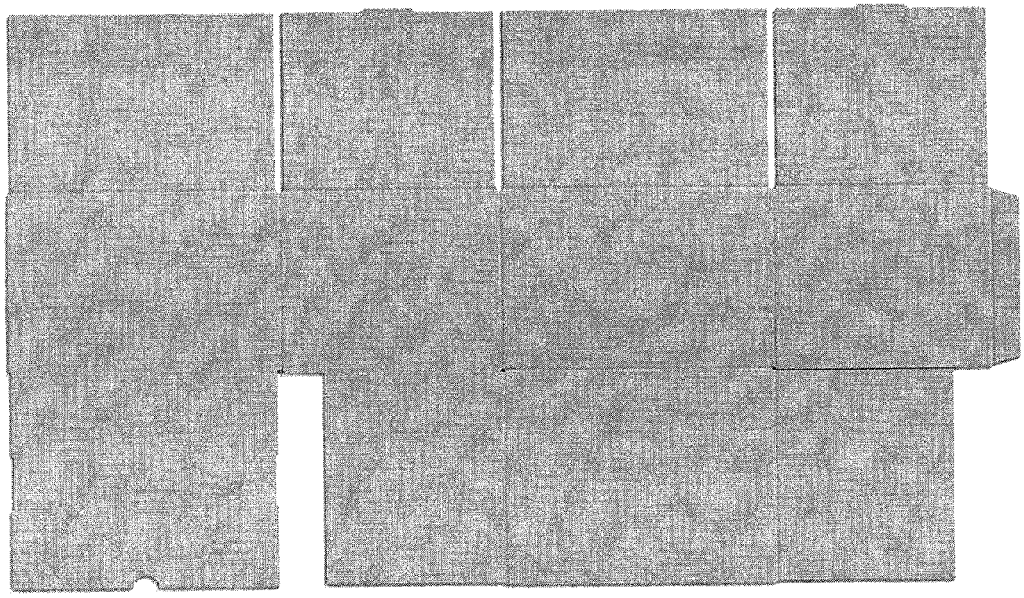
FIG. 12 is a rendering of a plan view of the box portion blank of FIG. 1.
Figure 13:
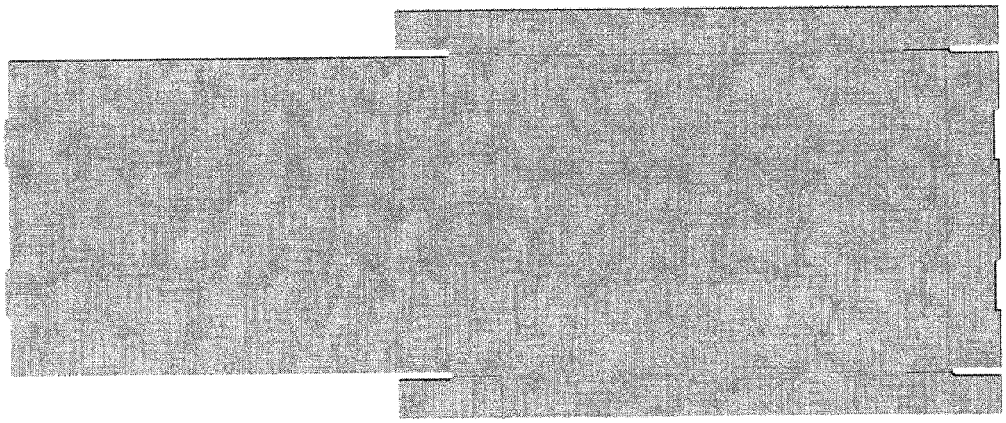
FIG. 13 is a rendering of a plan view of the lid portion blank of FIG. 2.
Figure 14:
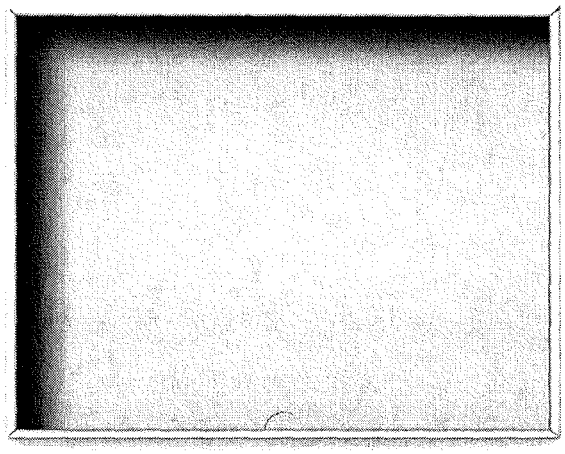
FIG. 14 is a rendering of a top view of the box portion showing the interior of the box portion.
Figure 15:
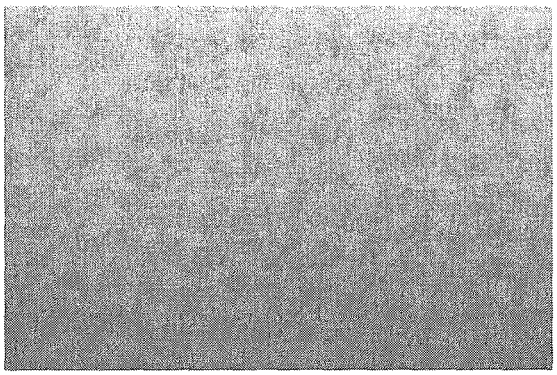
FIG. 15 is a rendering of a plan view of the long side of the box portion.
Figure 16:
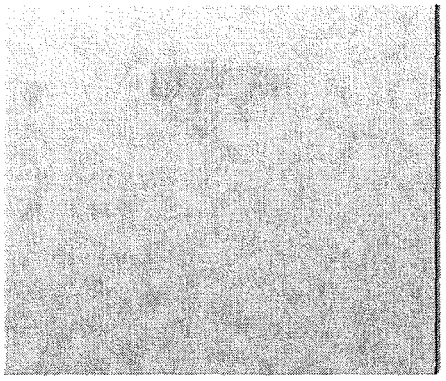
FIG. 16 is a rendering of a plan view of the short side of the box portion.
Figure 17:
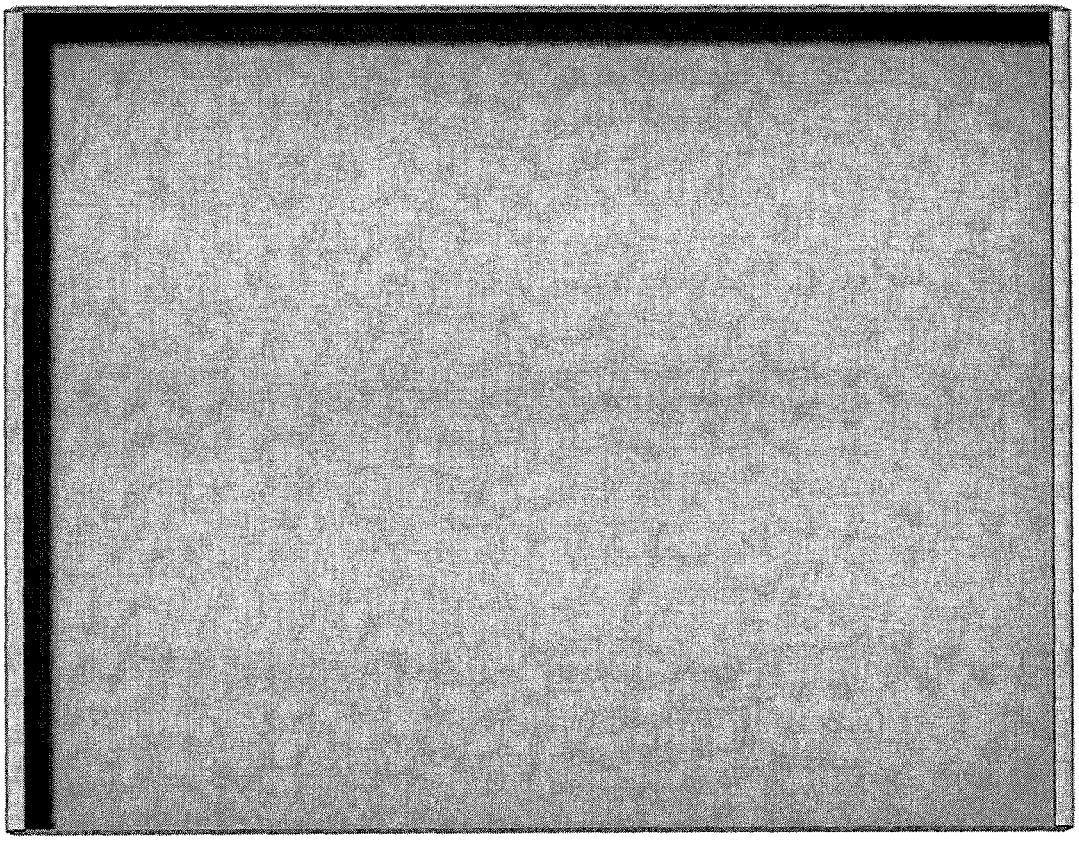
FIG. 17 is a rendering of a bottom view of the lid portion showing the interior of the lid.
Figure 18:
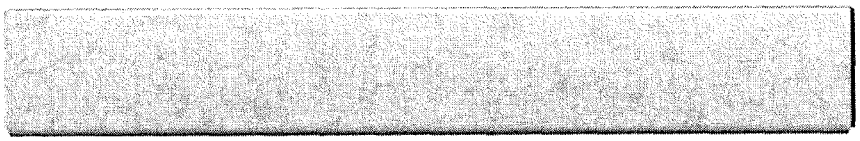
FIG. 18 is a rendering of a plan view of the long side of the lid portion.
Figure 19:
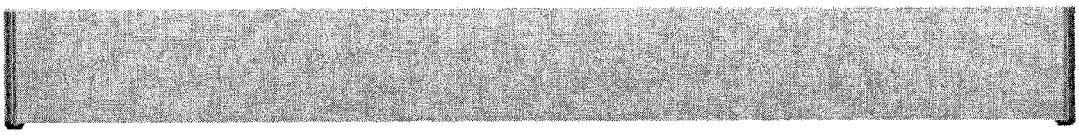
FIG. 19 is a rendering of a plan view of the short side of the box portion.

Turning now to the figures, which illustrate an exemplary embodiment of the invention, FIGS. 1 and 2 show the box blank 100 and lid blank 200, respectively, and FIGS. 3-10 illustrate the exemplary steps for folding the blanks into the fully assembled configuration, which is depicted in FIG. 11. FIGS. 12 and 13 show renderings of a top view of the box and lid blanks in the same orientation as FIGS. 1 and 2, respectively. It should be understood that the bottom views of said blanks are essentially a mirror image of the views shown in FIGS. 12 and 13 and that from the side, these blanks resemble any sheet of cardboard stock, with the lines associated with each contour of the cut shape of the blank projected onto those side views. FIGS. 14-16 illustrate, from various views, the fully assembled box and FIGS. 17-19 illustrate, from various views, the fully assembled lid. It should be understood that although only one short or long side of the box or lid are shown in FIGS. 15, 16, 18 and 19, the opposite side view of each is identical. Similarly, it should be understood that a bottom view of the box portion and a top view of the lid portion are essentially identical rectangular shapes. Finally, it should be understood that the relative dimensions of the box and lid assembly are not necessarily to scale, and that the various parts of the assembly may be of any size or shape. One exemplary embodiment, such as the one depicted herein, may have an approximate width of 12 inches, length of 15 inches, and depth of 10 inches, and may be constructed of corrugated cardboard stock.

Box portion blank as shown in FIG. 1 comprises a number of faces and flaps, separated by fold lines, cuts, or perforations between adjacent areas. As shown in FIG. 11, the fully assembled box assembly is rectangular in shape. While box assemblies according to the invention are not limited to a rectangular shape, for purposes of illustration, the rectangular shape of the exemplary box and lid shown herein permits reference to a "short side" and a "long side" of the box, and thus such reference will be made herein. It should be understood, however, that in other embodiments, all sides may be of equal length. For ease of discussion, the following are the faces and flaps of the box portion blank as illustrated in FIG. 1.

101—affixation flap
102, 104—box outer shell long sides
106, 108—box outer shell short sides
110, 112—sandwiched side flaps
114—bottom
116—locking flap
118, 120—long side inner liner flaps
122, 124—short side inner liner flaps An exemplary sequence for folding the box portion blank will now be discussed with reference to FIGS. 6-10. Prior to the steps shown in FIG. 6, the box portion is folded along fold lines 162, 164, and 166 so that the adjacent faces lie in perpendicular planes to one another, and the outer surface (the side facing the viewer in FIG. 1) of affixation flap 101 is then affixed to the inner surface (the side facing away from the viewer of FIG. 1) of outer shell long side face 102, creating the assembly shown in FIG. 6. Affixation flap 101 may be affixed to face 102 by any means known in the art, such as by gluing, stapling (or affixing with any type of mechanical fastener not limited to a staple), melting (for materials of construction, such as plastic resins, that permit melting of parts together), or some combination thereof, or by any means of affixation suitable for creating a bond that will withstand the designed load for the box. The partially formed box portion so created now has an exterior (defined by the portions of faces 102 and 108 visible in FIG. 6) and an interior (defined by the portions of faces 104 and 106 visible in FIG. 6). It should be noted that affixation flap 101 may be affixed to face 102 as described above before sale of the box portion to a consumer. The resulting partially constructed blank can still lie flat with all of the faces lying along a singular plane (or, more precisely, two parallel, planes spaced apart only by the distance of the cardboard thickness) for easy storage and transport, and then can be assembled by the end user only by folding as described herein next.

Figure 6:
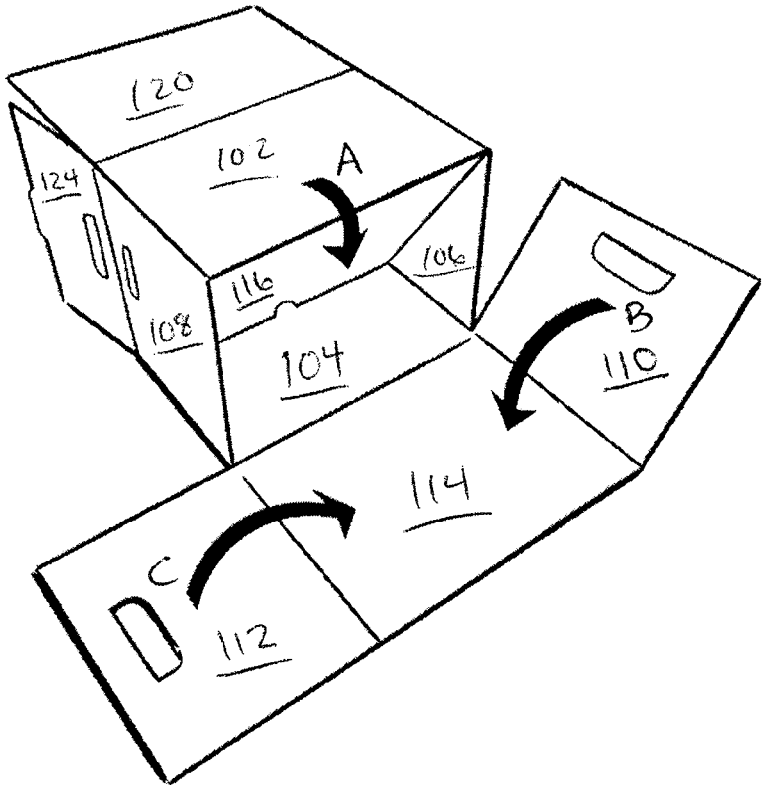
FIG. 6 is a perspective view illustrating initial steps in an exemplary process for folding the box portion of FIG. 1 from an unassembled into an assembled configuration.
Figure 7:
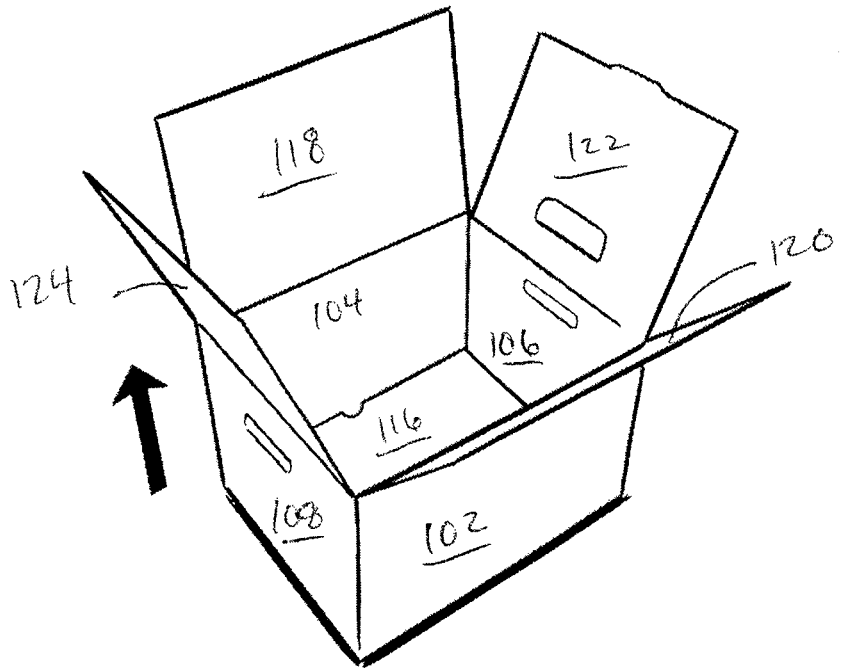
FIG. 7 is a perspective view illustrating steps after those illustrated in FIG. 6, for folding the box portion of FIG. 1 from an unassembled into an assembled configuration.

As shown in FIG. 6, locking flap 116 is first folded along fold line 168, as illustrated by arrow A, so that it rests in the interior of the box. Then, sandwiched side flaps 110 and 112 are folded along fold lines 170 and 172, as shown by arrows B and C, such that their faces are substantially parallel to the face of bottom 114. It should be noted that lines 109 and 115 separating flap 110 from face 106 and flap 112 from face 108, respectively, as shown in FIG. 1, are cut lines (illustrated in solid lines) rather than fold lines (illustrated with dashed lines). The substantially parallel faces/flaps 110, 112, and 114 are then folded along fold line 171 so that bottom 114 rests in a plane perpendicular to the planes of faces 102, 104, 106, and 108. As illustrated in FIG. 7, the box portion may then, most conveniently but not as a matter of necessity, be placed so that the box rests on bottom face 114 such that the opening framed by the sides the box faces toward the assembler.

Figure 8:
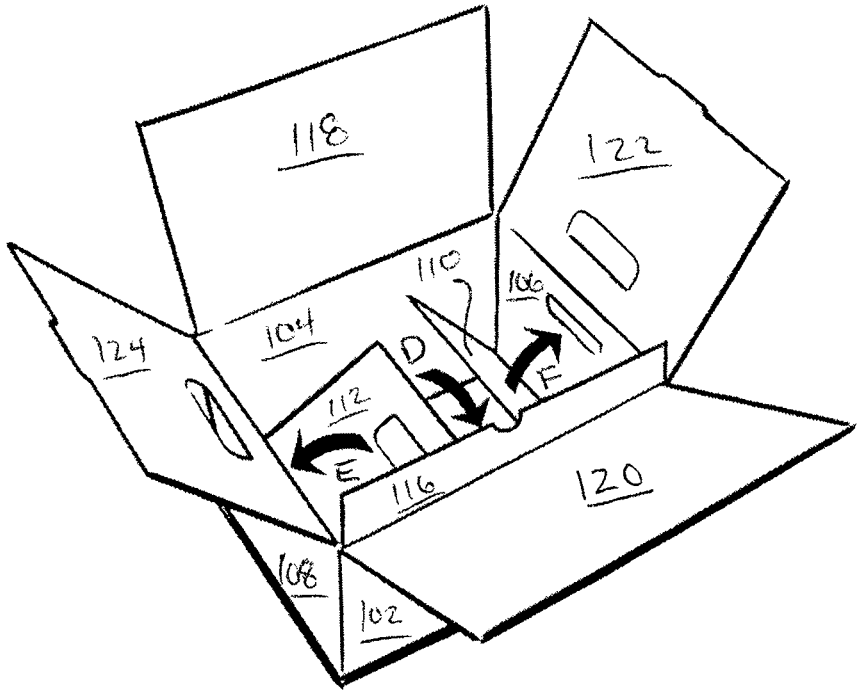
FIG. 8 is a perspective view illustrating steps after those illustrated in FIG. 7, for folding the box portion of FIG. 1 from an unassembled into an assembled configuration.

Next, as illustrated in FIG. 8, locking flap 116 is further folded along line 168, as shown by arrow D, such that flap 116 is parallel to face 102 within the interior of the box portion, and sandwiched side flaps 110 and 112 are then folded along lines 170 and 172, as shown by arrows E and F, respectively, such that they lie parallel to faces 106 and 108, respectively, within the interior of the box portion. Then, as shown in FIG. 9, locking flap 116 is folded as shown by arrow G such that it lies parallel to bottom face 114. Finger hole 117 in locking flap 116 provides an opening through which a user can insert his or her finger to pull up locking flap to disassemble the box, if later desired.

Next, as illustrated in FIG. 10, long side inner liner flaps 118, 120 and short side inner liner flaps 122, 124 are folded inward toward the interior of the box along fold line 174 and fold lines 178, 176, 177, and 179, as shown by arrows H, I, J, and K. respectively. The preferred sequence is to fold along arrows H and I first, and then fold along arrows J and K, so that tabs 130 and 132 interface with the slots that are defined by indents 150 and 152 of locking flap 116 and the adjacent faces of sides 108 and 106 in the assembled configuration. Fold lines 178, 176, 177, and 179 are displaced from fold line 174 by a distance necessary to wrap around the thickness of sandwiched flaps 110 and 112, which then become sandwiched between faces 106 and 122 and between faces 108 and 124, respectively. Thus, areas 180, 181, 182, and 183 between fold line 174 and fold lines 176, 177, 178, and 179, respectively, define a cooperating set of flat top edges that define the top periphery surrounding the opening of the fully assembled box portion. The cooperating flat top edges create an aesthetically pleasing look, which is further enhanced by the mitered corners 185 of each edge portion that abut adjacent mitred corners of adjacent edge portions at each intersection along the periphery. This aesthetically pleasing configuration is best shown in FIG. 14.

Box portion preferably has handle cutouts for easy transport of the box by users. Thus, for example, cuts 139 and 141 create holes 138 and 140 in faces 110 and 112 respectively, and cuts 135 and 137 create holes 134 and 136 in faces 122 and 124, respectively. Furthermore, cuts 143 and 145 create flaps 143 and 144 in faces 106 and 108, such that when in the assembled configuration shown in FIG. 10, flap 143 and holes 138 and 134 align with one another and flap 144 and holes 140 and 136 align with one another, permitting the flaps to be folded toward the box interior along fold lines 195 and 196 for flap 142 and long fold lines 197 and 198 for flap 144, permitting a user to insert his or her hands within the holes to grab the box, with the smooth surface of the flaps protecting the user's hands from the roughness of the cut cardboard.

Lid portion as shown in FIG. 2 also has a number of faces, separated by fold lines (dashed lines), cuts (solid lines), or perforations between adjacent faces. As shown in FIG. 11, the fully assembled lid assembly is rectangular in shape. While lid assemblies according to the invention are not limited to a rectangular shape, for purposes of illustration, the rectangular shape of the exemplary lid embodiments depicted herein permit labeling of a "short side" and a "long side" of the lid, and thus reference will be made to such sides herein. It should be understood, however, that for a square lid, all sides will be of equal length. For ease of discussion, the following are the faces of the lid portion blank as illustrated in FIG. 2.

Figure 3:
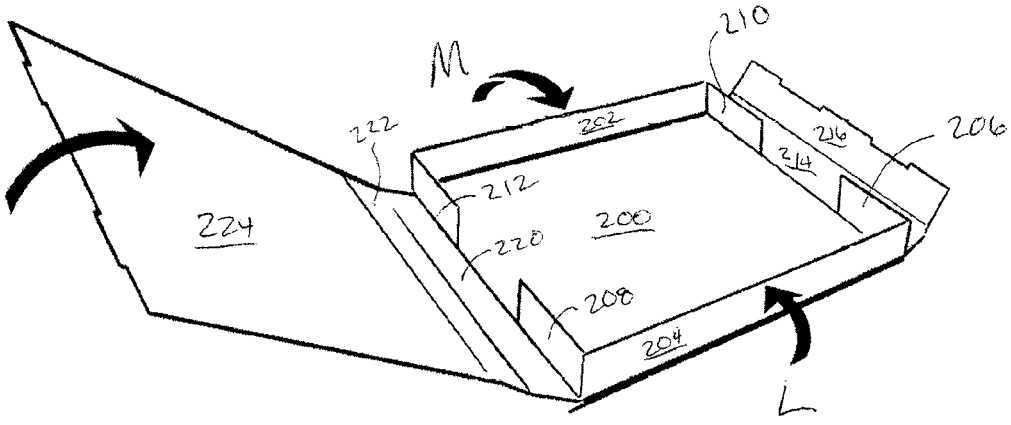
FIG. 3 is a perspective view illustrating initial steps in an exemplary process for folding the lid portion of FIG. 2 from an unassembled into an assembled configuration.
Figure 4:
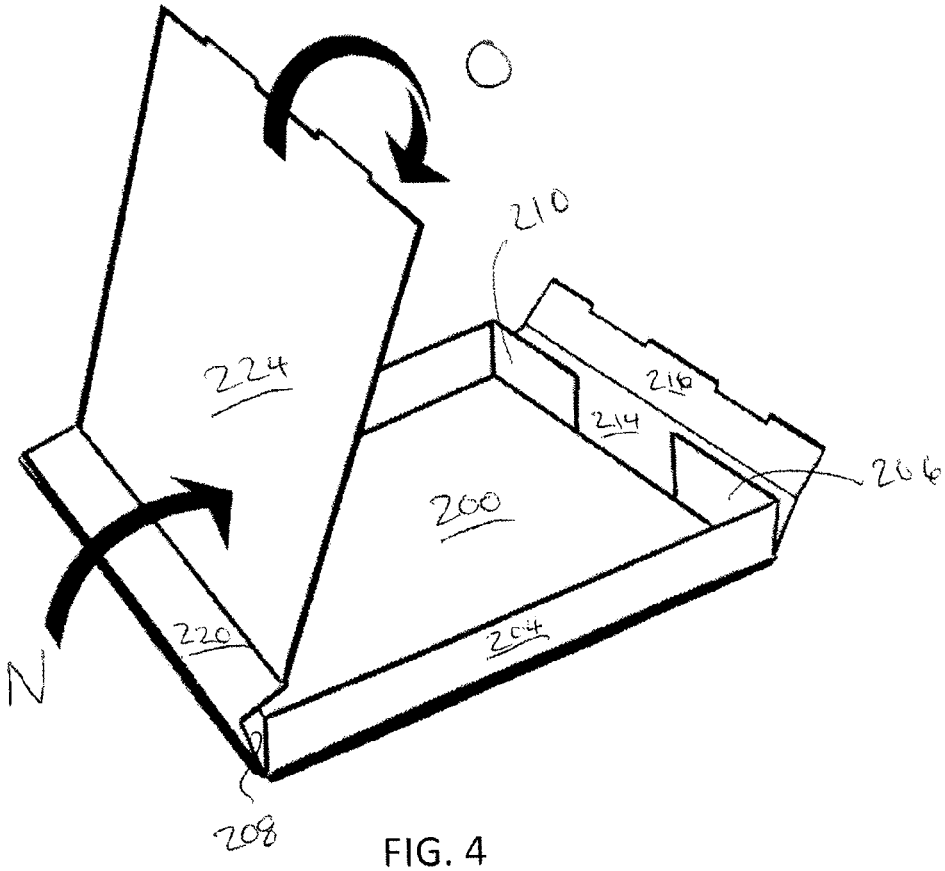
FIG. 4 is a perspective view illustrating steps after those illustrated in FIG. 3, for folding the lid portion of FIG. 2 from an unassembled into an assembled configuration.

200—lid outer shell top
202, 204—lid long sides
214, 220—lid outer shell short sides
216, 222—lid inner liner short sides
224—lid locking flap
216, 214—lid short side inner liner flaps
206, 208, 210, 212—lid sandwiched side flaps An exemplary sequence for folding the lid portion blank will now be discussed with reference to FIGS. 3-5. First, as shown in FIG. 3, the lid long sides 202 and 204 are folded along lines 234 and 240, respectively, as illustrated by arrows L and M, such that they lie in a plane perpendicular to the lid outer shell top 200. Lid sandwiched side flaps 206, 208, 210, 212 (which are separated from adjacent flaps 214 and 220 by cuts 207, 209, 211, and 213, are folded along fold lines 238, 236, 232, and 230, respectively such that they lie in planes perpendicular to both the bottom 200 and their respective attached long sides. Lid outer shell short sides 214 and 220 are folded along lines 242 and 247 respectively, and locking flap 224 is then folded toward the center of the opening defined by the lid. As shown in FIG. 4, lid locking flap folds along both of fold lines 248 and 249, leaving a smooth edge between the fold lines and further folds along line 254, which separates lid inner liner short side 222 from locking flap 224. Line 254 may preferably be a perforated line, rather than a creased line, to facilitate locking flap 224 remaining parallel to the top 200 rather than it having some tendency to want to fold away from the top. Cuts 250 and 252 define flaps attached to lid locking flap 224. Locking flap 224 is folded along arrows N and O such that lid sandwiched side flaps 208 and 212 are sandwiched between lid outer shell short side 220 and lid inner liner short side 222 and such that the edge formed by fold line 254 abuts the inside (the side facing the viewer in FIG. 3) of lid outer shell top 200 and locking flap 224 lies parallel to lid outer shell top 200, thus forming an inner liner for the top of the lid.

Figure 5:
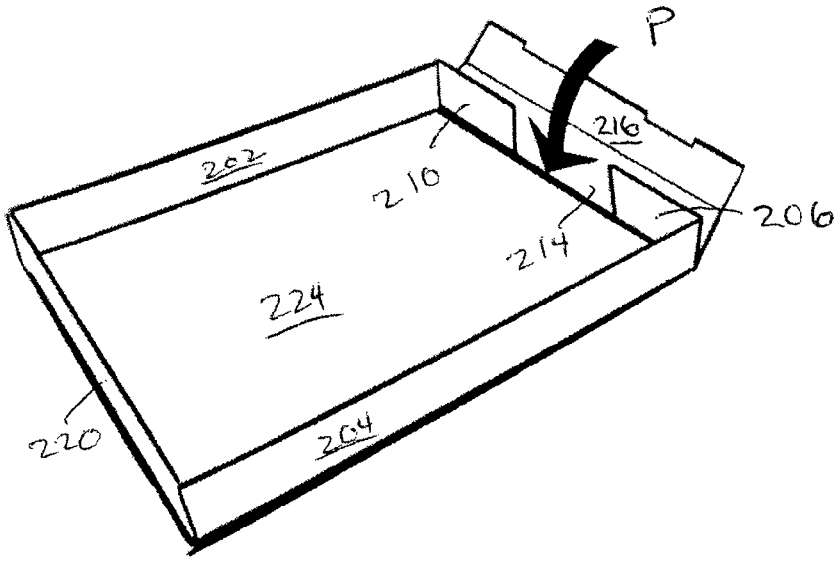
FIG. 5 is a perspective view illustrating steps after those illustrated in FIG. 4, for folding the lid portion of FIG. 2 from an unassembled into an assembled configuration.

Then, as shown in FIG. 5, lid outer shell short side is folded along fold line 242 such that it lies parallel to lid sandwiched side flaps 206 and 210, and lid short side inner liner 216 is folded along lines 243 and 244 as illustrated by arrow P, such that lid sandwiched side flaps 206 and 210 are sandwiched between lid outer shell short side 220 and lid inner liner short side 222 and such that the edge of flap 216 abuts the inside of lid outer shell top 200. Indents 215 and 217 create slots between the edge of flap 216 and top 200 which accommodate tabs 223 and 225, respectively, thus creating a more secure locked configuration.

It should be understood that while illustrated with indents and tabs in certain places in the design, other indents or slot and tab configurations may be provided to further secure the box and lid assembly in their respective assembled configurations. It should be further understood, that to the extent the embodiment depicted herein is rectangular, features described herein located on the "short side" could also be located on the "long side," and vice versa. For example, although the lid portion is depicted herein with has sandwiched side flaps connected to the long sides and the locking tab connected to one of the short side inner liner flaps, in another embodiment the locking tab may be located on the long side and the side flaps attached to the short sides. Similarly, the box portion may have the locking flap connected to the short side and the inner liner flaps provided on the long side.

Box assemblies constructed in accordance with this invention are strong, yet aesthetically pleasing around the upper periphery of the box portion because of the smooth mitred edges on all four sides, and are easily assembled by users. The layout of the blanks also facilitates coating the box material or printing patterns such that the assembled box may be more aesthetically pleasing than a traditional cardboard box. The box configuration is not limited to any particular patterns or coatings. Although ideally constructed of cardboard, any material suitable for folding may be used. It should be understood that although the box portion and lid portion having the configurations discussed herein are ideally suited to one another, a box portion as described herein may be matched with a lid portion having a different configuration, and vice versa.

In the configuration of the blank shown in FIG. 1, although 115 is a cut line separating flap 112 from face 108, a small perforated attachment 190, such as, for example, ⅛ inch attaching sections separated by ⅛ inch perforations, may be provided to better keep the blank in a planar configuration without undesired folding of certain portions, until the user desires to assemble the box. Thus, the user may need to break the attachment at perforation 190 before beginning to assemble the box. It should be understood that other such attachments may be provided, with or without perforations, for keeping cut sections of the blank in a flat configuration when desired.

In an alternate lid embodiment, depicted in FIGS. 20-23, instead of a locking flap 224 extending from one of the short side inner liners, a pair of locking flap liners 302 and 304 may be provided extending from each of the short sides, with the overall length of the pair of locking flap liners together being such that their leading edges 303 and 305 snugly abut one another inside the lid to form a 2-piece lid liner. In all other respects, this lid embodiment is essentially the same as the embodiment shown and described elsewhere herein. The embodiment shown elsewhere herein is preferred over this alternate embodiment because in this embodiment there may be a tendency for the two locking flap liners to separate. A piece of adhesive tape, however, may optionally be used to keep the locking flaps together.

Figure 20:
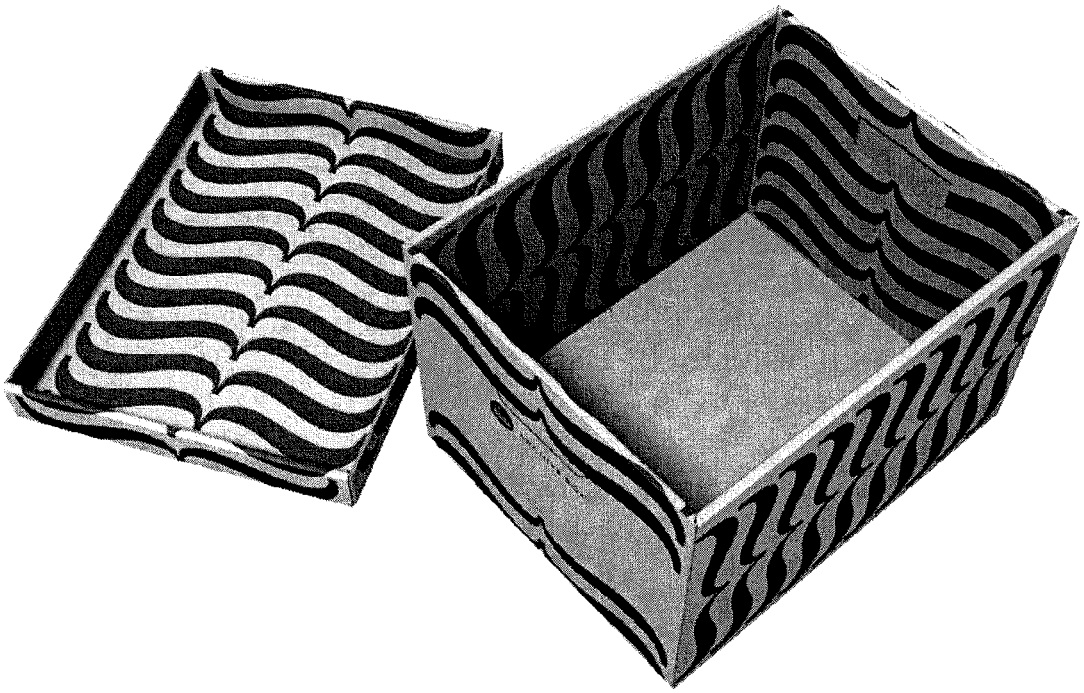
FIG. 20 is a 3-D perspective rendering of an exemplary box and an alternative embodiment lid assembly, with the lid separated from the box, showing an exemplary pattern printed on thereon.
Figure 21:
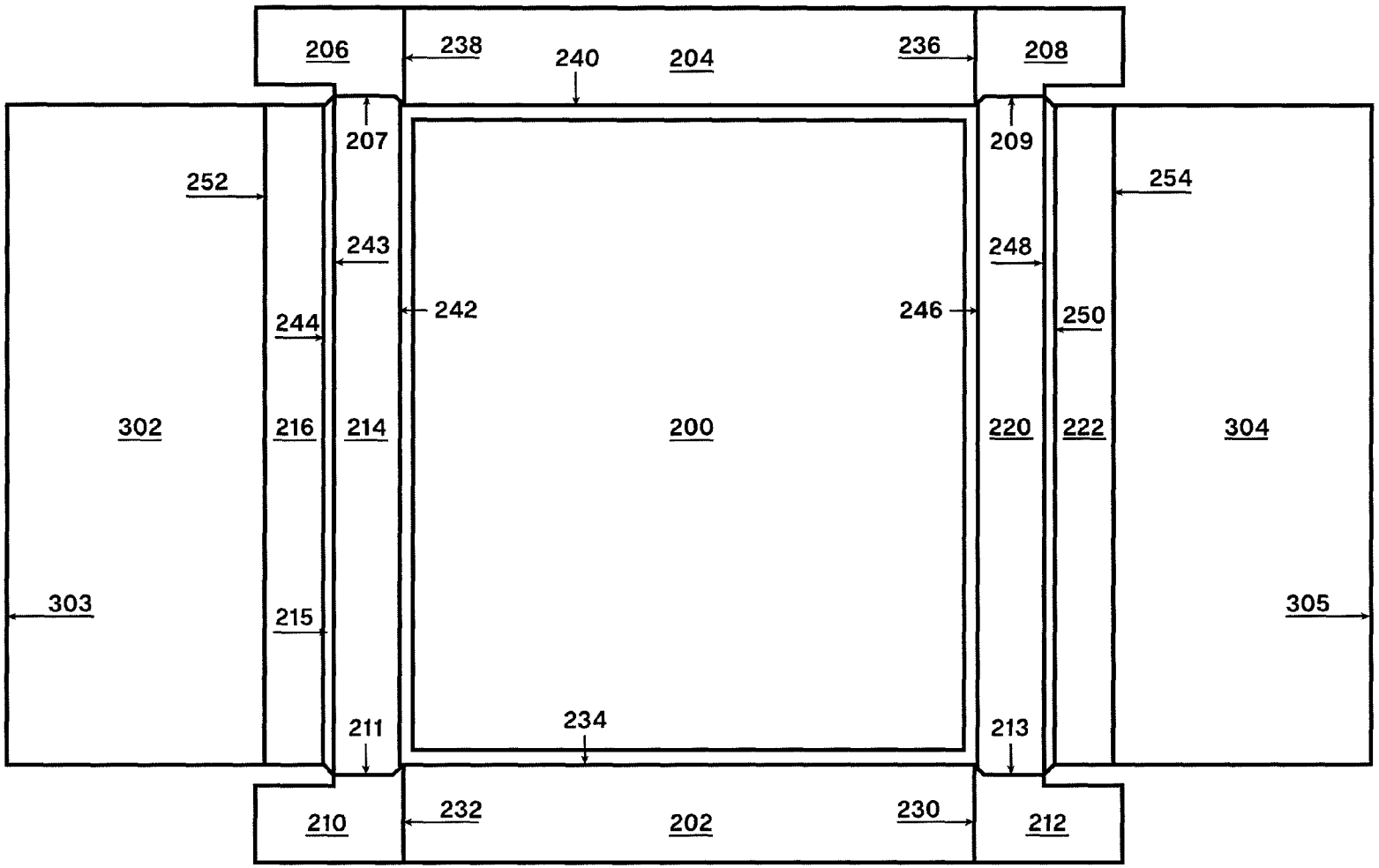
FIG. 21 is a plan view of a blank for the exemplary lid embodiment depicted in FIG. 20.
Figure 23:
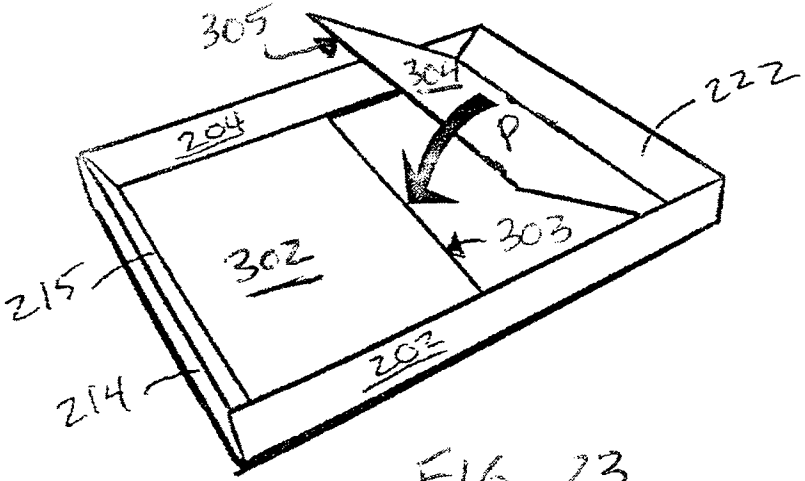
FIG. 23 is a perspective view illustrating steps after those illustrated in FIG. 22, for folding the lid portion embodiment of FIG. 21 from an unassembled into an assembled configuration.
Figure 22:
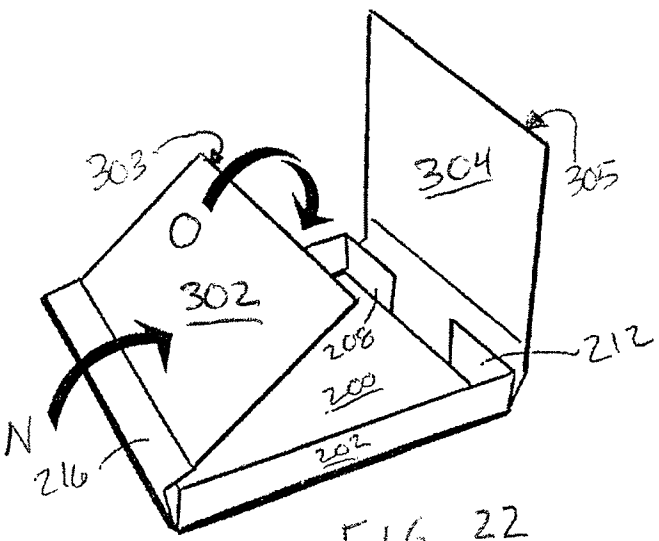
FIG. 22 is a perspective view illustrating initial steps in an exemplary process for folding the lid portion embodiment of FIG. 21 from an unassembled into an assembled configuration.

FIG. 20, in addition to depicting this alternate lid embodiment, also depicts the box and lid with the lid separated from the box, and also depicts an aesthetically pleasing pattern printed on the box. The box and lid assembly is not limited to this pattern or to any pattern, and use of such a pattern is not limited to use for any particular lid or box embodiment.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A collapsible cardboard box and lid assembly comprising:

a collapsible box portion having a fully assembled configuration defined by an outer shell having four sides and a bottom, and an open top defined by top edges of the four sides, each of the four sides comprising an outer face and an inner face flap connected to the outer face by one a plurality of fold-over regions that form the top edges of the four sides, each of the fold-over regions comprising mitered edges that align with the mitered edges of the fold over regions of the sides adjacent thereto to define mitered corners, the outer shell bottom having an outer face and two intermediate side flaps connected thereto, each of the intermediate side flaps sandwiched between the outer face and the inner face flap of one of the sides, said sides sandwiching said intermediate side flaps positioned opposite one another, said box portion further comprising a single locking flap connected to a remaining one of said four sides that locks said box in said assembled configuration and defines an interior bottom of the box portion, wherein at least two of said box inner side flaps comprise one or more tabs biased against an interior face of the outer shell bottom in said fully assembled configuration and said locking flap comprises one or more indents to accommodate said one or more tabs;

a collapsible lid portion having a fully assembled configuration defined by a top, having an inner portion and an outer portion, a shell having four sides, and an open bottom defined by top edges of the four sides, the top outer portion connected to a first set of opposite outer side faces defining two of said sides, said opposite outer side faces connected by a fold-over region to opposite inner side faces, with only one inner side face connected at a fold line to a single top locking liner flap that extends from the attached inner side face to a leading edge in abutment with the opposite inner side face to lock said lid portion in said assembled configuration, said top liner flap defining an interior of the lid portion, said top outer face further connected to a second set of opposite outer side faces defining a remaining two of the four sides, said second set of opposite outer side faces connected to opposite intermediate flaps sandwiched between said first set of opposite outer side faces and inner side faces, wherein the top liner flap comprises one or more tabs on its leading edge that mesh with one or more slots to lock the lid in the assembled configuration, each slot defined by an indent in a leading edge of the opposite inner face in abutment with an inner surface of the top outer portion.

2. The assembly of claim 1, wherein the box in the fully assembled configuration further comprises a flap extending from one of said sides, the flap having an outer face adhered face-to-face to an inner face of the side adjacent thereto in the fully assembled configuration, said adhered flap sandwiched between the outer face and inner face of the side to which it is adhered in the fully assembled configuration.

3. The assembly of claim 1, wherein at least two of said box inner side flaps comprise one or more tabs biased against an interior face of the outer shell bottom in said fully assembled configuration and said locking flap comprises one or more indents to accommodate said one or more tabs.

4. The assembly of claim 1, wherein said inner side flaps and said intermediate side flaps on at least two sides each comprise handle openings, and at least two of said outer sides each comprise a handle flap for folding into said handle openings.

5. The collapsible box and lid assembly of claim 1, wherein the collapsible box portion further comprises an affixation flap extending from one of the sides and affixed to another of the sides.

6. The collapsible box and lid assembly of claim 5, wherein the affixation flap is affixed with an adhesive, a mechanical fastener, or a combination thereof.

7. A collapsible lid, the collapsible lid having a fully assembled configuration defined by a top having an inner portion and an outer portion, a shell having four sides, and an open bottom defined by top edges of the four sides, the top outer portion connected to a first set of opposite outer side faces defining two of said sides, said opposite outer side faces connected by a fold-over region to opposite inner side faces, with one of said inner side faces connected at a fold line to a single top locking liner flap that extends from the attached inner side face to an abutment with the opposite inner side face to lock said lid portion in said assembled configuration, said at least one top liner flap defining the lid inner portion, said top outer face further connected to a second set of opposite outer side faces defining a remaining two of the four sides, said second set of opposite outer side faces connected to opposite intermediate flaps sandwiched between said first set of opposite outer side faces and inner side faces, wherein the top liner flap comprises one or more tabs on its leading edge that mesh with or more slots to lock the lid in the assembled configuration, each slot defined by an indent in a leading edge of the opposite inner side face in abutment with an inner surface of the top outer portion.

* * * * *